US007905654B1

(12) United States Patent
Cordero

(10) Patent No.: US 7,905,654 B1
(45) Date of Patent: Mar. 15, 2011

(54) HAND HELD MANUALLY OPERATED MIXER

(76) Inventor: Luis Cordero, Plantation, FL (US)

( * ) Notice: Subject to any disclaimer, the term of this patent is extended or adjusted under 35 U.S.C. 154(b) by 988 days.

(21) Appl. No.: 11/787,972

(22) Filed: Apr. 18, 2007

Related U.S. Application Data

(60) Provisional application No. 60/858,506, filed on Nov. 13, 2006.

(51) Int. Cl.
*B01F 3/12* (2006.01)

(52) U.S. Cl. ..... 366/256; 366/332

(58) Field of Classification Search ..... 366/130, 366/139, 189, 255–260, 285–286, 332–335; 206/219

See application file for complete search history.

(56) References Cited

U.S. PATENT DOCUMENTS

| | | | | |
|---|---|---|---|---|
| 1,455,664 | A * | 5/1923 | Russell | 366/256 |
| 1,836,026 | A * | 12/1931 | Helle | 366/256 |
| 1,998,692 | A * | 4/1935 | Harrison et al. | 366/333 |
| 2,825,134 | A * | 3/1958 | Hicks | 433/90 |
| 3,140,078 | A * | 7/1964 | Grubb et al. | 366/256 |
| 3,164,303 | A * | 1/1965 | Trautmann | 222/190 |
| 3,195,778 | A * | 7/1965 | Coates | 222/80 |
| 4,090,612 | A | 5/1978 | Lostutter | |
| 4,114,196 | A | 9/1978 | Lostutter | |
| 4,208,133 | A * | 6/1980 | Korte-Jungermann | 366/130 |
| 4,469,153 | A * | 9/1984 | Morrisette | 141/364 |
| 4,676,406 | A * | 6/1987 | Frischmann et al. | 222/136 |
| 4,676,655 | A * | 6/1987 | Handler | 366/130 |
| 4,735,509 | A | 4/1988 | Rausch | |
| 4,793,957 | A | 12/1988 | Lovegrove | |
| 4,799,801 | A * | 1/1989 | Bruning | 366/255 |
| 4,858,759 | A * | 8/1989 | Mauthe et al. | 206/221 |
| 4,966,468 | A * | 10/1990 | Bruning | 366/333 |
| 5,044,758 | A * | 9/1991 | Kurtz | 366/77 |
| 5,779,356 | A * | 7/1998 | Chan | 366/139 |
| 6,755,563 | B2 * | 6/2004 | Wahlig et al. | 366/139 |
| 6,910,799 | B2 | 6/2005 | Renfro | |
| 7,070,318 | B2 | 7/2006 | Renfro | |
| 7,527,421 | B2 * | 5/2009 | Anderson et al. | 366/69 |
| 7,798,363 | B2 * | 9/2010 | Brandon | 222/1 |
| 2002/0065353 | A1 * | 5/2002 | Anderson et al. | 524/492 |
| 2006/0151531 | A1 * | 7/2006 | Tikusis | 222/145.6 |

* cited by examiner

*Primary Examiner* — Charles E Cooley
(74) *Attorney, Agent, or Firm* — Gold & Rizvi, P.A.; H. John Rizvi; Glenn E. Gold

(57) ABSTRACT

A method using a mixer for disbursing an additive in a tube of compound. The mixer includes a rigid cylinder and a plunger assembly. The cylinder is configured for receiving an opened tube of compound, to which additive has been introduced. The plunger assembly includes a shaft on which a cap is slidably and rotatably mounted. A mixer blade is mounted on a first end of the shaft and a second end of the shaft is provided with a handle. The cap is provided with a pair of cutouts designed for receiving a pair of studs mounted on the outside surface of the cylinder, such that the cap may be fitted on the cylinder and turned to engage the studs with the cutouts and connect the cap and the cylinder. The handle may be rotated and reciprocated to move the mixer blade through the contents of the tube for mixing.

6 Claims, 4 Drawing Sheets

HAND HELD MANUALLY OPERATED MIXER

CROSS-REFERENCE TO RELATED APPLICATION

This application claims the benefit of co-pending U.S. Provisional Patent Application Ser. No. 60/858,506, filed on Nov. 13, 2006, which is incorporated herein in its entirety.

BACKGROUND OF THE INVENTION

1. Field of the Invention

The present invention relates to methods and apparatus for mixing an additive with a compound having a viscous and stiff consistency, and more particularly to methods using a hand held manually operated mixer capable of distributing an additive throughout such a compound disposed inside a retail dispensing tube.

2. Description of the Prior Art

Compounds used for caulking and grouting are formulated to be workable but viscous and relatively stiff. These compounds are formulated for application to joints and cracks by pressing the compound into an opening and smoothing the exposed surface, with the use of a tool designed for the purpose. The stiffness prevents the material from readily migrating, after application, even when the compound is applied on a vertical wall. The viscosity causes the compound to adhere to the surfaces in cracks and joints to achieve a complete filling of the space, even when the compound is dragged somewhat by the smoothing phase of the work.

Unfortunately, the viscosity and stiffness, which make the compounds suitable for grouting and caulking also make the compounds difficult to handle. Suppliers have responded by delivering compounds for caulking and grouting in retail dispenser tubes. The tubes are typically a plastic or lined paperboard cylinder with a fixed wall at a front end and a thrust cap at an opposite filler end. The fixed wall is provided with a centered hole, through which a tapered dispenser tip extends. The supplier fills the tube, through the filler end and inserts the thrust cap to seal the compound inside the cylinder. The user opens the tube, for use, by cutting the dispenser tip at a location selected to provide an opening of desired diameter. The user places the tube in a caulking gun, which is configured with a ratchet driven trigger mechanism for gradually advancing a push rod. The push rod engages the thrust cap, of the tube, and presses the thrust cap forward through the tube to dispense the compound through the opening in the tip. The user may move the tip over an area where the compound is to be applied while operating the trigger mechanism to dispense the compound at a desired rate. The compound may be smoothed after it is applied to finish the job. The retail tube and calking gun allow a user to dispense the compound directly where it is needed without the necessity of removing the compound from the tube or otherwise handling the compound prior to use.

The retail tube and caulking gun are ideal for pre-mixed or one step compounds, which can be sold in the ready-to-use tubes; however, when an additive is required, the user must handle the compound to some extent. Certain quick setting compounds require that a catalyst be added immediately before use. For certain caulking jobs, it is desirable that the caulking compound be tinted with colorant before use, in order to match the compound with the color of adjacent surfaces such as walls or ceilings. While it is possible to add colorant in advance, it is not practical for a supplier to provide various compositions of caulking compound in all color variations. It is standard practice to purchase an untinted caulking compound and to add the colorant by mixing. When a fast acting catalyst is required or when color tinted caulk is needed, the user must mix an additive with the compound.

In order to minimize the handling of the compound, typical conventional methods of mixing an additive with caulking or grouting compound are practiced with the compound remaining in the retail tube. A U.S. Patent Application 2006/0151531, to Tikusis discloses a method of supplying the additive in a separate reservoir, which is disposed in the tube beside the compound. The additive and the compound are dispensed simultaneously into the dispenser tip and are mixed as they are dispensed. Another method, disclosed by U.S. Pat. No. 4,114,196, to Lostutter, uses a frame configured to hold retail tubes of compound and adapted for loading on a conventional paint shaker. The thrust cap is removed, the additive introduced to the compound inside the tube, and the tube is shaken to mix the additive and the compound. Finally, U.S. Pat. No. 7,070,318, to Renfro discloses a mixer blade mounted on a shaft. A mixer head is slidably and rotatably mounted on the shaft and the mixer head is configured for sealable engagement with the filler end of the tube. Two motors are used to rotate and reciprocate the mixer blade inside the tube containing the additive and the compound.

Alternatively, one motor may be used to rotate the mixer blade and reciprocation may be supplied manually in the manner of a soda fountain milkshake mixer. The mixer blade is designed with a continuous circumferential edge which is intended to remain adjacent to the inside surface of the tube, for scraping the compound from the side of the tube during the mixing operation.

Generally, the method of mixing the additive and the compound in the dispensing tip, at the point of application does not yield acceptable results, particularly in the case of color tinting, where a thorough and even dispersal of the colorant is necessary to achieve uniform appearance. The mechanical shaker of Lostutter and the mixing apparatus of Renfro require bulky equipment and a power source. These methods are suitable for mixing, by the retailer, at the point of sale.

There is a need for an effective apparatus and method of mixing an additive into a compound, in the retail tube, which can be used at a work site.

There is a need for an effective apparatus and method of mixing an additive into a compound, in the retail tube, which does not require bulky equipment or a power source.

Finally, there is a need for a hand held manually operated mixer and method for mixing an additive into a compound, in the retail tube.

SUMMARY OF THE INVENTION

The present invention is directed to methods using a hand held manually operated mixer which is designed to receive a retail tube of calking or grouting compound, into which an additive has been introduced, and to thoroughly disperse the additive in the compound, within the tube. After mixing, the tube may be opened and disposed in a caulking gun, in a conventional manner, for use in the usual way. The mixer includes a rigid cylinder, a plunger assembly, a gasket and fastening means. The rigid cylinder is provided with stop means, at a distal end, for engaging the front end of the tube. The stop means may be a cup, with a circular opening. The cup is affixed to the cylinder, proximate to the distal end. The cylinder and the opening are designed so that the tube of compound may be disposed, in slidable and close fitting relation within the cylinder, with the tapered dispenser tip protruding through the opening, with the front end of the tube abutting the cup, and with the open filler end presented near a proximal end, of the cylinder. The plunger assembly includes a rigid shaft, a cap, a gasket, a mixer blade, and a handle. The cap is slidably and rotatably mounted on the shaft. The mixer blade is mounted on a first end of the shaft and a handle is provided on an opposite second end of the shaft. The fastening means is designed for connecting the proximal end of the cylinder and the cap in releasable interlocking engagement, such that the mixer blade is disposed inside the cylinder and the handle is disposed outside the cylinder.

A user may remove the thrust cap, at the filler end of a tube of compound, introduce a measure of additive, place the tube inside the cylinder, install the cap, and engage the fastening means to connect the cap and the cylinder. Manual force may be applied to the handle to rotate and reciprocate the mixing blade within the tube to thoroughly mix the additive with the compound. After mixing, the user may remove the cap, slide the tube from the cylinder and replace the thrust cap, to make the tube ready for use.

It is an object of the present invention to provide a mixer and method for mixing an additive to a tube of compound at a work site, or at home.

It is another object of the present invention to provide a mixer and method for mixing an additive to a tube of compound which does not require bulky equipment or a power source.

It is yet another object of the present invention to provide a hand held manually operated mixer and method for mixing an additive to a tube of compound.

BRIEF DESCRIPTION OF THE DRAWINGS

The invention will be further understood, by way of example, with reference to the accompanying drawings, in which.

DETAILED DESCRIPTION OF THE PREFERRED EMBODIMENTS

Figure 1:
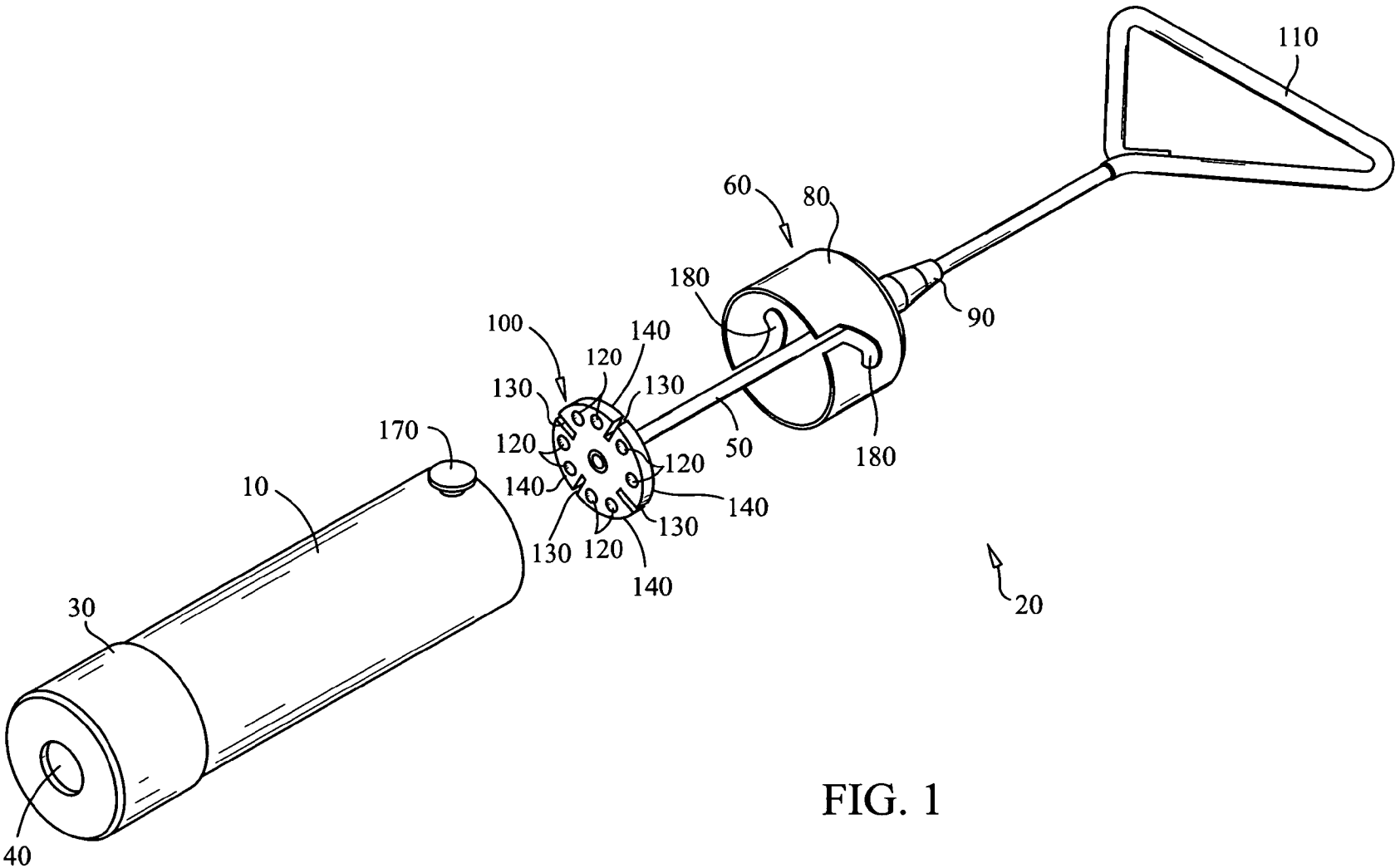
FIG. 1 is a perspective view of the mixer of the present invention.

Shown throughout the drawings, the present invention is generally directed toward a method using a hand held manually operated mixer for disbursing an additive within a compound, while the compound remains in a retail tube. The mixer comprises a rigid cylinder 10, a plunger assembly 20, and fastening means, all as shown in FIG. 1. The fastening means serves to connect the rigid cylinder 10 and the plunger assembly 20, as will be explained below.

The rigid cylinder 10 is preferably formed of metal or plastic having a thickness sufficient to prevent deformity when being firmly manipulated by hand. A thickness of approximately one millimeter is preferred. The cylinder 10 has a proximal end and a distal end. The cylinder 10 is selected to have a length and inside diameter appropriate for receiving a retail tube of caulking compound, through the proximal end, in slidable and close fitting relation. Stop means are provided at the distal end of the cylinder 10, to prevent the tube from proceeding out through the distal end. The stop means preferably consists of a cup 30 formed of the same material used to form the cylinder 10 and designed for close fitting slidable engagement with the outer surface of the cylinder 10. The cup 30 may be attached to the cylinder 10 by welding, gluing or other conventional means. The cup 30 is provided with a circular opening 40 centered on the longitudinal axis of the cylinder 10, for receiving a dispenser tip, of the tube of caulking material therethrough, with the front of the tube abutting the cup 30.

Figure 2:
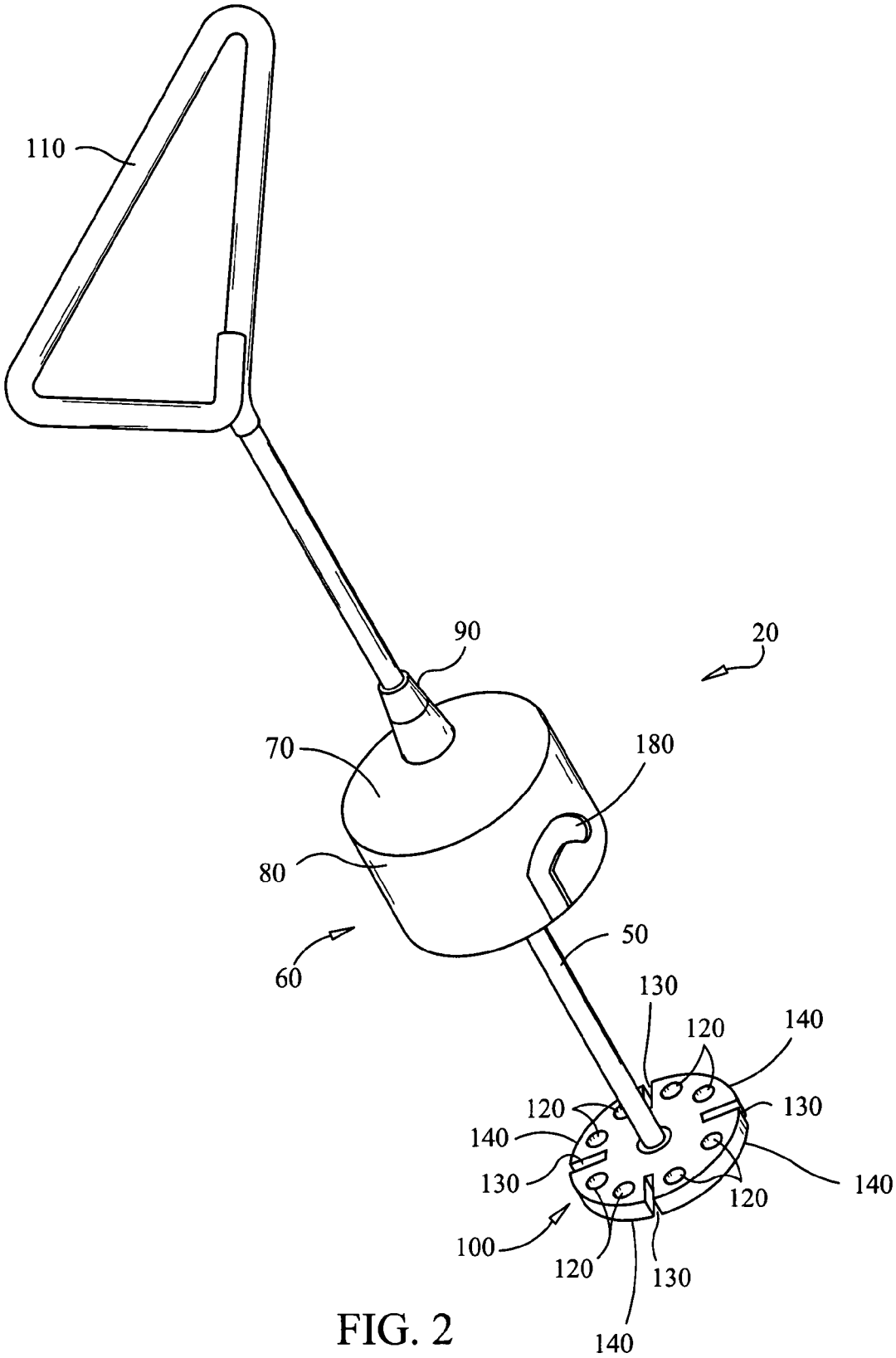
FIG. 2 is a perspective view of the plunger assembly of the present invention.

The plunger assembly 20, as shown in FIG. 2, includes a rigid shaft 50, preferably formed of steel, having a circular cross section, and having a first end and a second end. A cap 60 is slidably and rotatably mounted on the shaft 50. The cap 60 preferably includes a generally disk shaped base 70 and a cylindrical wall 80 projecting generally perpendicularly from the periphery of the base 70. An aperture is provided proximate to the center of the base 70. An elongate tapered nipple 90 is mounted over the aperture, on the base 70, and projects perpendicular to the base 70, in a direction opposite the wall 80. The nipple 90 is provided with a longitudinal through bore aligned with the aperture. The nipple 90 may be integrally formed with the cap 60 or may be separately formed and attached by welding, gluing, or other conventional means. The aperture and the through bore are designed for receiving the shaft such that the wall 80 projects toward the first end of the shaft 50 and the nipple 90 projects toward the second end of the shaft 50. It is intended that the relative size of the aperture and the through bore, with respect to the diameter of the shaft provide a close fit while allowing the shaft to freely rotate and reciprocate with respect to the cap 60. A mixer blade 100 is mounted on the first end of the shaft 50 and a handle 110 is provided on the second end of the shaft 50. The cap 60 and nipple 90 may preferably be formed of the same material as the cylinder 10 and the mixer blade 100 and handle 110 may preferably be formed of the same material as the shaft 50.

Figure 3:
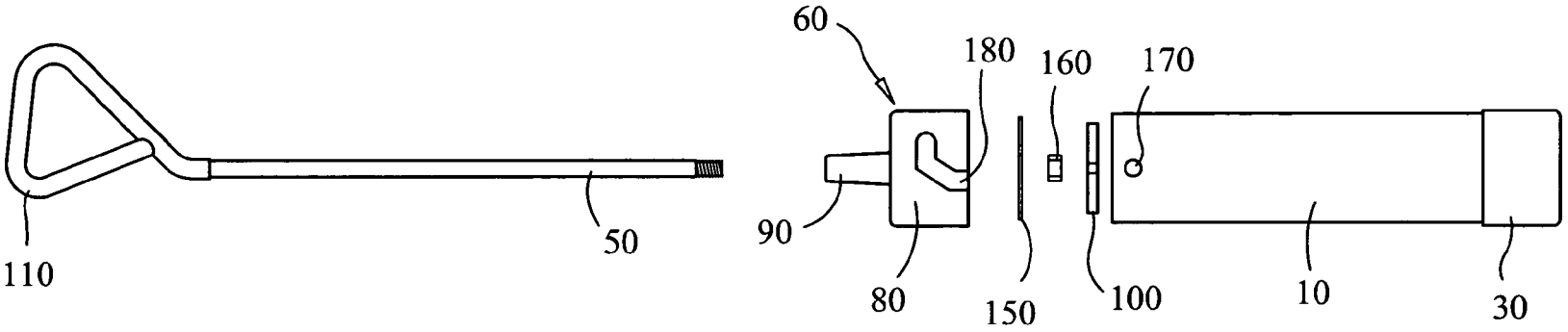
FIG. 3 is an exploded plan view of the mixer of the present invention.
Figure 4:
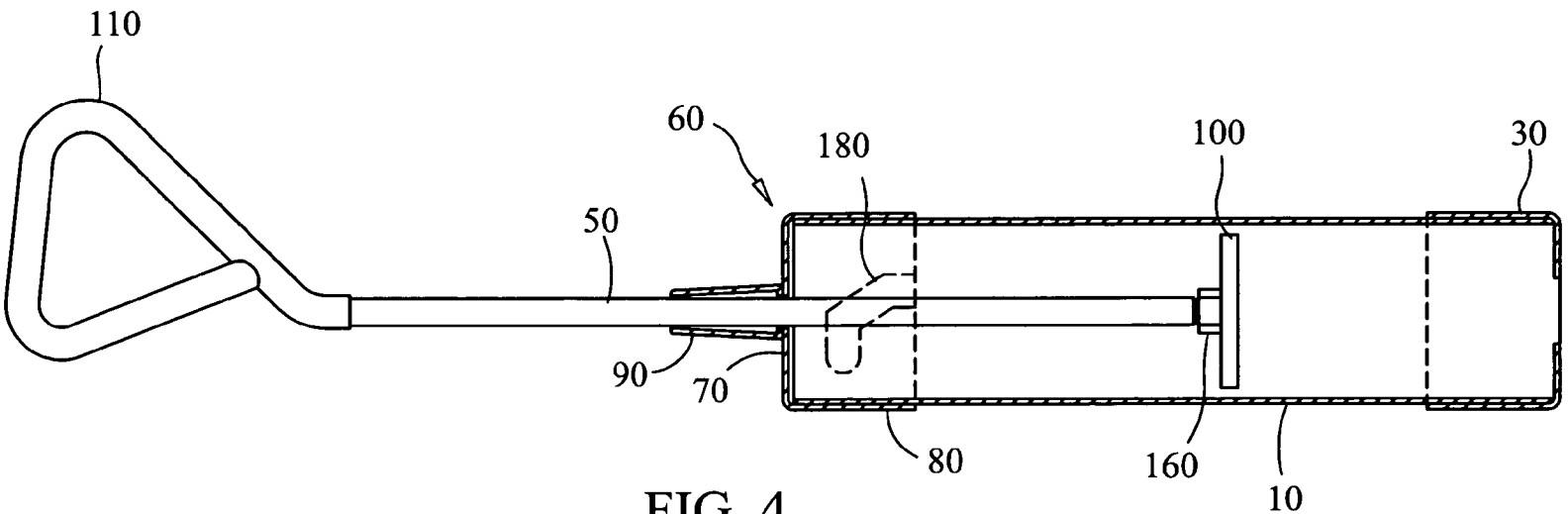
FIG. 4 is a plan view of the mixer of the present invention.

It is preferred that the mixer blade 100 is generally disk shaped having a thickness of approximately two to seven millimeters and a diameter selected to closely match the inside diameter of a retail tube of caulking compound. It is preferred that the first end of the shaft 50 be threaded, as shown in FIG. 3, and that the mixer blade 100 be provided with a centered hole, having matched threads, for receiving the shaft 50. A nut 160 may be threaded onto the shaft 50 adjacent to the mixer blade 100, as shown in FIGS. 3 and 4, to prevent separation of the mixer blade 100 and shaft 50. It is also preferred that the mixer blade 100 be mounted perpendicular to the shaft 50. The mixer blade 100 is preferably formed with a plurality of perforations 120, notches 130, and non-continuous circumferential edges 140, as shown in FIGS. 1 and 2. It is intended that the perforations 120 and the notches 130 will direct compound over the mixer blade 100 and that the edges 140 will circulate compound adjacent to the side of the tube. The handle 110 is preferably formed integrally with the shaft by turning the shaft in a loop, to provide a convenient grip. It is preferred that the handle 110 be asymmetrically offset from the longitudinal axis of the shaft to facilitate simultaneous rotation and reciprocation of the shaft 50, as shown in FIG. 3.

An exploded view of the cylinder 10 and plunger assembly 20 is shown in FIG. 3. It is preferred that the plunger assembly 20 also include a generally disk shaped gasket 150 attached inside the cap 60, adjacent to the base 70, by attachment means, preferably by gluing or cementing, for retaining the gasket 150 inside the cap 60. The gasket 150 assists in preventing caulk from leaking through the wall 80 of the cap 60 as the shaft 50 is withdrawn. It is preferred that the gasket 150 be formed of rubber or other resilient material, have a diameter greater than the diameter of a retail tube of compound, and have a centered hole for receiving the shaft 50 therethrough. It is intended that the cap 60 may be slidably received onto the proximal end of the cylinder 10, so as to dispose the first end of the shaft 50 and the mixer blade 100 inside the cylinder 10 and to dispose the second end of the shaft 50 and the handle 110 outside the cylinder 10, as shown in FIG. 4. Fastening means are provided to connect the cap 60 to the proximal end of the cylinder 10, in releasable interlocking engagement. Fastening means are preferably a pair of opposed studs 170 affixed to the outside surface of the cylinder 10 proximate to the proximal end and a pair of opposed cutouts 180 on the wall 80 of the cap 60. Each of the pair of cutouts 180 has an entry point, for receiving a one of the studs 170, at the periphery of the wall 80 and a communicating pathway leading to a boxed end. The pair of cutouts 180 is angled and aligned such that manual turning of the cap 60 causes the studs 170 to advance along the pathways and tighten the engagement between the cap 60 and the cylinder 10.

Figure 5:
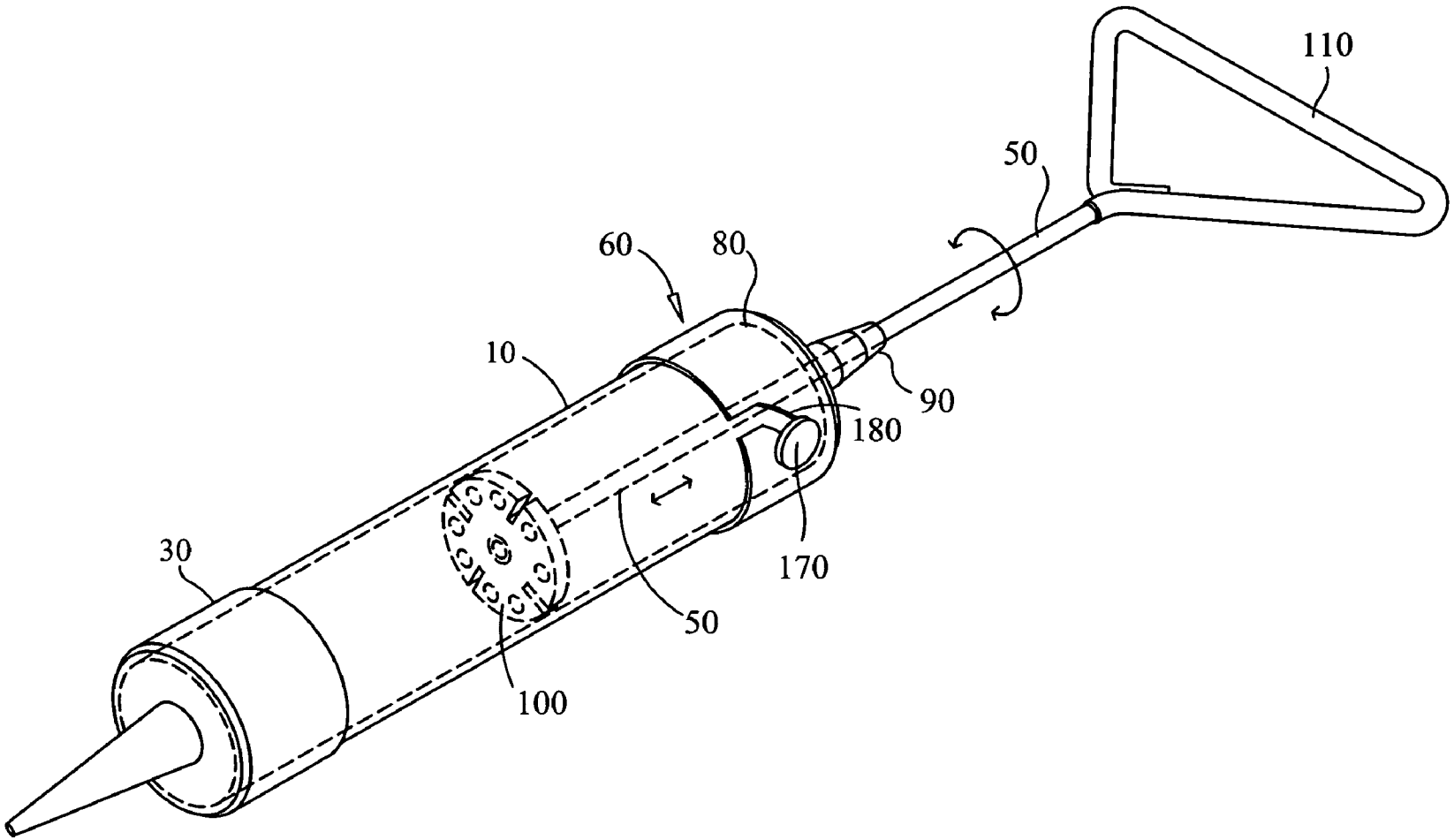
FIG. 5 is a perspective view of the present invention with a tube of compound depicted in dotted lines, inside the cylinder and with the fastening means engaged.

A user desiring to mix an additive, such as colorant, into a tube of caulking compound may remove the thrust cap from the filler end of the tube and introduce the additive to the tube of compound. The user may place the open ended tube into the cylinder 10, allowing the tube to abut the cup 30 and the dispenser tip to protrude through the opening 40. It is understood that the open filler end of the tube is presented near the proximal end of the cylinder. The user connects the cap 60 to the cylinder 10, engaging the fastening means by turning the cap 60. It is intended that the mixer blade 100 is disposed in the tube and that the turning of the cap 60 presses the tube between the cup 30 and the gasket 150 which seals the filler end of the tube, as shown in FIG. 5. The user may grasp the handle 110 to manually rotate and reciprocate the mixer blade 100 within the tube to thoroughly disburse the additive in the compound. In FIG. 5, rotation is indicated by a curved arrow and reciprocation is indicated by a straight arrow. When mixing is complete, the user may disengage the fastening means, remove the tube and replace the thrust cap. The tube of compound and additive is ready for use in a conventional manner.

The mixer of the present invention is compact and may be conveniently carried to a work site. It is not necessary to have any additional equipment nor is a power supply required to operate the mixer. The cylinder 10 encapsulates the tube and prevents rupturing during the mixing process. The nipple 90 supports the shaft 50 to maintain proper alignment as the shaft 50 reciprocates in the tube. It will be appreciated that the mixer of the present invention is suitable or may be adapted for use with any material disposed in a cylindrical container.

It is contemplated that other conventional fastening means may be employed to connect the cylinder 10 to the plunger assembly 20, without departing from the scope of the invention, as disclosed and claimed herein. Also, while the preferred embodiments have been described above, it will be recognized and understood that various modifications may be made and other conventional materials may be substituted for forming the components of the invention, with comparable results. The appended claims are intended to cover all such modifications and substitutions that come within the spirit and scope of the invention.

What is claimed is:

1. A method for disbursing an additive in an open ended tube of compound comprising the steps of:

providing a rigid cylinder, a plunger assembly, and fastening means; said rigid cylinder having a proximal end and a distal end; said distal end having stop means for abutting said tube; said plunger assembly including a rigid shaft, having a first end and a second end, a cap, a mixer blade, and a handle; said cap being slidably and rotatably mounted on said shaft; said mixer blade being mounted on said shaft, proximate to said first end; and said handle being provided, on said shaft, proximate to said second end; said fastening means being designed for connecting said cap to the proximal end of said cylinder in releasable interlocking engagement, such that said mixer blade is disposed inside said cylinder and said handle is disposed outside said cylinder;

placing said tube inside said cylinder abutting said stop means and presenting said open end near said proximal end of said cylinder;

connecting said cap to said cylinder, with said fastening means;

rotating and reciprocating said handle, manually, to mix said additive and said compound.

2. The method of claim 1, wherein:

a nipple is provided on said cap;

said nipple includes a longitudinal through bore for receiving said shaft in a slidable and rotatable supporting relation.

3. The method of claim 1, wherein:

said mixer blade is generally disk shaped;

said mixer blade is provided with a plurality of notches, perforations, and non-continuous circumferential edges; and the diameter of said mixer blade is selected to closely match the inside diameter of said tube.

4. The method of claim 1, wherein:

said handle is asymmetrically offset from the longitudinal axis of said shaft, for facilitating simultaneous rotation and reciprocation of said mixer blade.

5. The method of claim 1, wherein, said fastening means comprises:

a pair of studs provided on the outer surface of said cylinder; and a pair or cutouts on said cap;

said cutouts being configured and angled to receive and confine said studs for tightening the engagement between said cap and said cylinder, with turning of said cap.

6. The method of claim 1, wherein the step of: providing a rigid cylinder, a plunger assembly, and fastening means; said rigid cylinder having a proximal end and a distal end; said distal end having stop means for abutting said tube; said plunger assembly including a rigid shaft, having a first end and a second end, a cap, a mixer blade, and a handle; said cap being slidably and rotatably mounted on said shaft; said mixer blade being mounted on said shaft, proximate to said first end; and said handle being provided, on said shaft, proximate to said second end; said fastening means being designed for connecting said cap to the proximal end of said cylinder in releasable interlocking engagement, such that said mixer blade is disposed inside said cylinder and said handle is disposed outside said cylinder;

further includes, providing a gasket disposed adjacent to said cap; said gasket being sized and configured for cooperating with said fastening means to seal said open ended tube, inside said cylinder.

* * * * *